US005660275A

United States Patent [19]

Hilsop et al.

[11] Patent Number: 5,660,275

[45] Date of Patent: Aug. 26, 1997

[54] DRY OR COOL ACCESSORIES BAG FOR PULL-TYPE GOLF CARTS

[76] Inventors: Dennis M. Hilsop, P.O. Box 385, Houston, Ak. 99694; David A. Stilwell, HC-34 Box 2046, Wasilla, Ak. 99654-9601

[21] Appl. No.: 671,808

[22] Filed: Jun. 25, 1996

Related U.S. Application Data

[63] Continuation of Ser. No. 415,412, Apr. 3, 1995, abandoned.

[51] Int. Cl.[6] ..... A63B 55/00

[52] U.S. Cl. ..... 206/315.5; 206/315.3; 383/66; 383/907; 280/650

[58] Field of Search ..... 206/315.1, 315.2, 206/315.3, 315.5; 150/108, 159; 383/24, 66, 907, 15, 38; 190/8, 102; 280/647, 650, 769

[56] References Cited

U.S. PATENT DOCUMENTS

| | | | |
|---|---|---|---|
| 1,291,914 | 1/1919 | Kelley | 383/24 |
| 2,375,819 | 5/1945 | Reid | 383/38 |
| 2,754,869 | 7/1956 | Bartels | 383/15 |
| 3,346,155 | 10/1967 | Oechsle | 150/108 |
| 3,797,043 | 3/1974 | Brument | 383/15 |
| 3,955,728 | 5/1976 | Jackson et al. | 383/907 |
| 3,965,953 | 6/1976 | Becker et al. | 383/66 |
| 4,114,667 | 9/1978 | Belson | 383/66 |
| 4,240,480 | 12/1980 | Strobel | 383/15 |
| 4,248,443 | 2/1981 | Ohlson | 280/650 |
| 4,317,581 | 3/1982 | Kassai | 280/650 |
| 4,356,854 | 11/1982 | McGee | 383/38 |
| 4,459,827 | 7/1984 | Rhodes | 224/174 |
| 4,815,764 | 3/1989 | Carpenter | 383/24 |
| 4,889,267 | 12/1989 | Bolton | 224/274 |
| 4,953,887 | 9/1990 | Takahashi et al. | 280/650 |
| 4,989,656 | 2/1991 | Derfler | 150/108 |
| 5,031,807 | 7/1991 | Tiffany | 150/108 |
| 5,193,842 | 3/1993 | Fontewot | 280/47.26 |
| 5,238,305 | 8/1993 | Feller | 383/24 |
| 5,277,328 | 1/1994 | Tocco | 206/315.3 |
| 5,341,928 | 8/1994 | Jones et al. | 206/315.5 |
| 5,402,883 | 4/1995 | Shin | 206/315.5 |

*Primary Examiner*—David T. Fidei
*Attorney, Agent, or Firm*—Michael J. Tavella

[57] ABSTRACT

A accessories bag for golf having attachment straps (26): and "D" rings (24): for attaching to the frame work of conventional pull-type golf carts (80). A sport zipper (22): provides access to the interior of the accessories bag (10). The supple and durable water resistant material that comprises the accessories bag (10): allows it to collapse with the conventional pull-type golf cart for storage and transportation.

8 Claims, 4 Drawing Sheets

DRY OR COOL ACCESSORIES BAG FOR PULL-TYPE GOLF CARTS

This application is a continuation of application Ser. No. 08/415,412, filed Apr. 3, 1995, now abandoned.

BACKGROUND

1. Field of Invention

This invention relates to storage containers designed to attach to a conventional pull-type golf cart and carry dry or cold accessories.

2. Description of Art

There is a need for additional accessories storage, particularly for an inexpensive collapsible container that can be attached to pull-type golf carts. Various inventions were conceived but they are replete with disadvantages and limitations. U.S. Pat. No. 4,459,827 to Rhodes (1984) is a device that can be used on most any conventional golf bag, but is limited in capacity and is designed to hold a specific product. U.S. Pat. No. 5,193,842 Fontenot (1993) is a device to carry a golf bag as well as having a platform for a beverage cooler, but is prohibitively expensive and requires complicated manufacturing. U.S. Pat. No. 4,889,267 to Bolton (1989) is a device that is attached to the lower front portion of a pull-type golf cart. The device is a platform only and requires the purchase of additional items. The device also posses stability and transportation problems. U.S. Pat. No. 5,277,328 to Tocco (1994) requires complicated manufacturing, poses stability problems and must be removed for transportation and storage. None of the aforementioned patents describe or suggest the present invention. Therefore, the need for an inexpensive collapsible container that attaches to a pull-type golf cart still exists.

OBJECTS AND ADVANTAGES

Accordingly, the present invention will provide an inexpensive collapsible container, with further objects and advantages being (a) to provide a device that will hold ice-packs for the purpose of keeping items in the container cool;

(b) to provide cool storage for bottled or canned beverages;

(c) to provide storage for food or snack items;

(d) to provide additional dry storage for any item a golfer may need on the golf course;

(e) to provide a device that will attach to most any conventional pull-type golf cart;

(f) to provide a device with convenient and easy access;

(g) to provide a device that is durable and water resistant;

(h) to provide a device that is simple and affordable.

Further objects and advantages are to provide a device that is lightweight and easy to clean, with the device being fabricated from existing conventional materials.

BRIEF DESCRIPTION OF THE DRAWINGS

Referring now to the drawings one will begin to understand the simplicity of the device.

Figure 1:
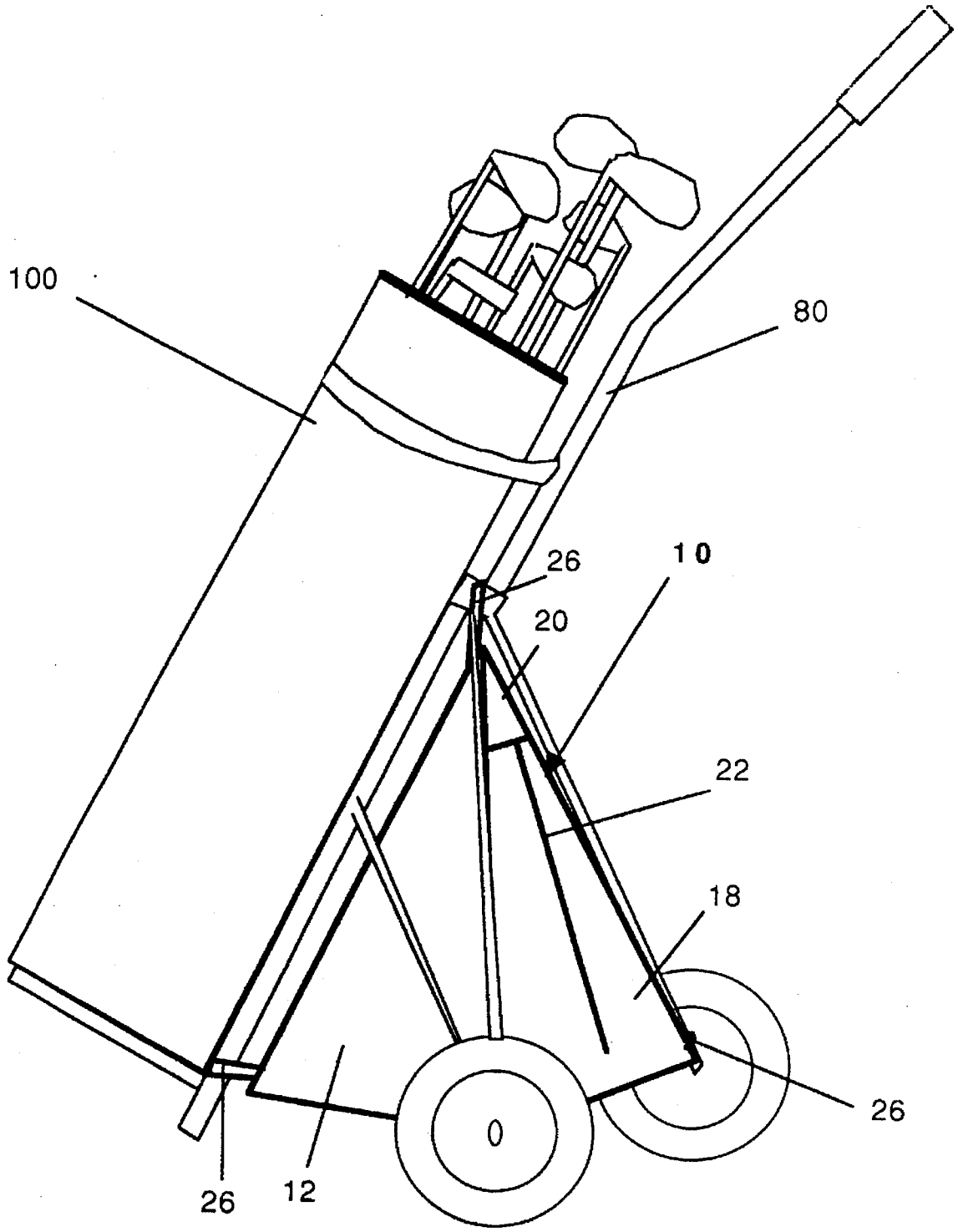
FIG. 1 is a perspective view of device 10 shown attached to a conventional pull-type golf cart.

| Reference Numerals in Drawings | |
|---|---|
| 10 Dry or Cool device | 12 left panel |
| 14 right panel | 16 bottom panel |
| 18 front panel | 20 weathergaurd panel |
| 22a cut for zipper | 22 sport zipper |
| 24 "D" rings | 26 attachment straps |
| 80 connventional pull-type golf cart | 100 conventional golf bag |

DETAILED DESCRIPTION OF THE DRAWINGS

FIG. 1 shows a preferred embodiment of the present invention in the form of device 10. Device 10 is attached to the underside of a conventional pull-type golf cart 80 with attachment straps 26, and does not interfere with access or attachment of a conventional golf bag 100. The zipper 22 is located for easy access with its top under weathergaurd 20 as shown in FIG. 4.

Figure 2:
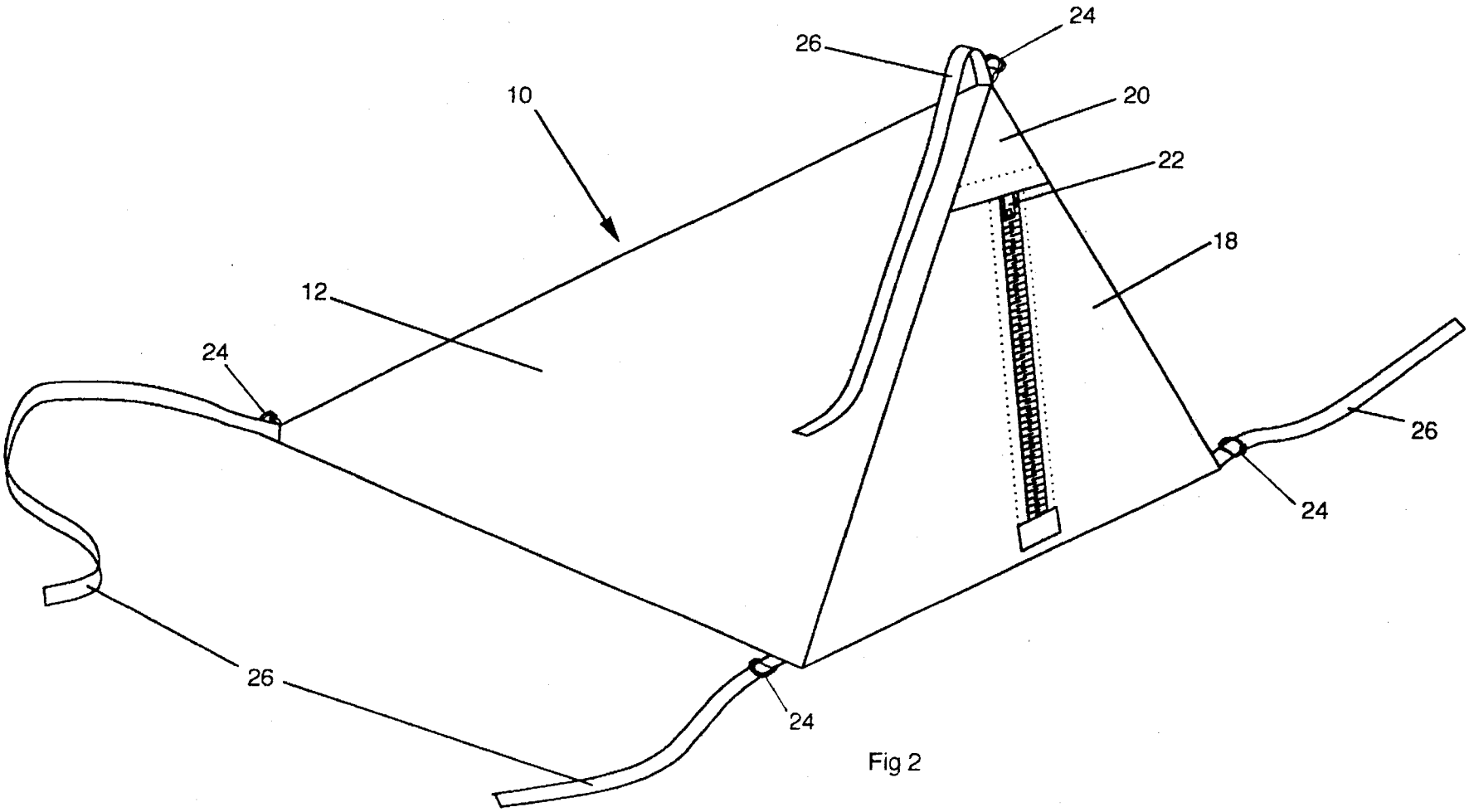
FIG. 2 is a perspective view of device 10 that forms the basis for the present invention.

In FIG. 2 we see a left hand perspective view of device 10. Left panel 12 is shown as it is attached to front panel 18 and weathergaurd panel 20. Sport zipper 22 is located to provide fast and easy access to the interior of device 10. The "D" rings 24 and straps 26 are visible at four locations and are used for attaching device 10 to a conventional pull-type golf cart 80 as shown in FIG. 1.

Figure 3:
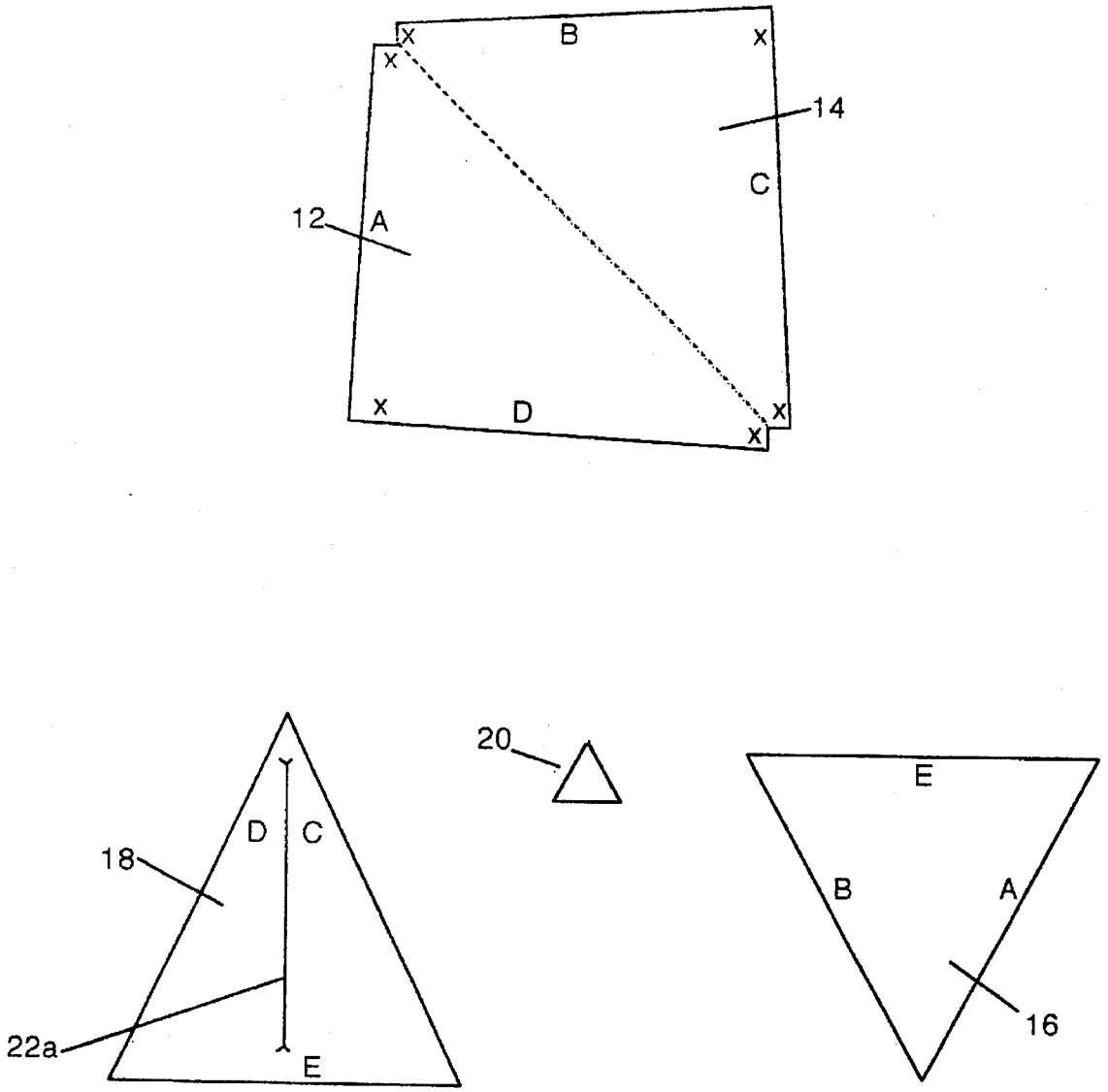
FIG. 3 is the flat layout of device 10 prior to cutting and assembly.

FIG. 3 shows the main body components of device 10 as they would be laid out on the desirable material prior to cutting and assembly. The capital letters are to designate adjoining sides, for instance side (A) of left panel 12 is attached to side (A) of bottom panel 16 and side (B) of right panel 14 is attached to side (B) of bottom panel 16 and so forth. Attachment points for straps 26 and "D" rings 24 are located on the corners of left panel 12 and right panel 14 as shown in FIG. 3. Front panel 18 is shown in FIG. 3 with a cut **22*a* for installing sport zipper 22. Weathergaurd panel 20 is shown with additional material to fold over and hem to provide a finished edge where weathergaurd panel 20 overlaps front panel 18. This provides a weather seal for the top of sport zipper 22 as shown in FIG. 4**.

Figure 4:
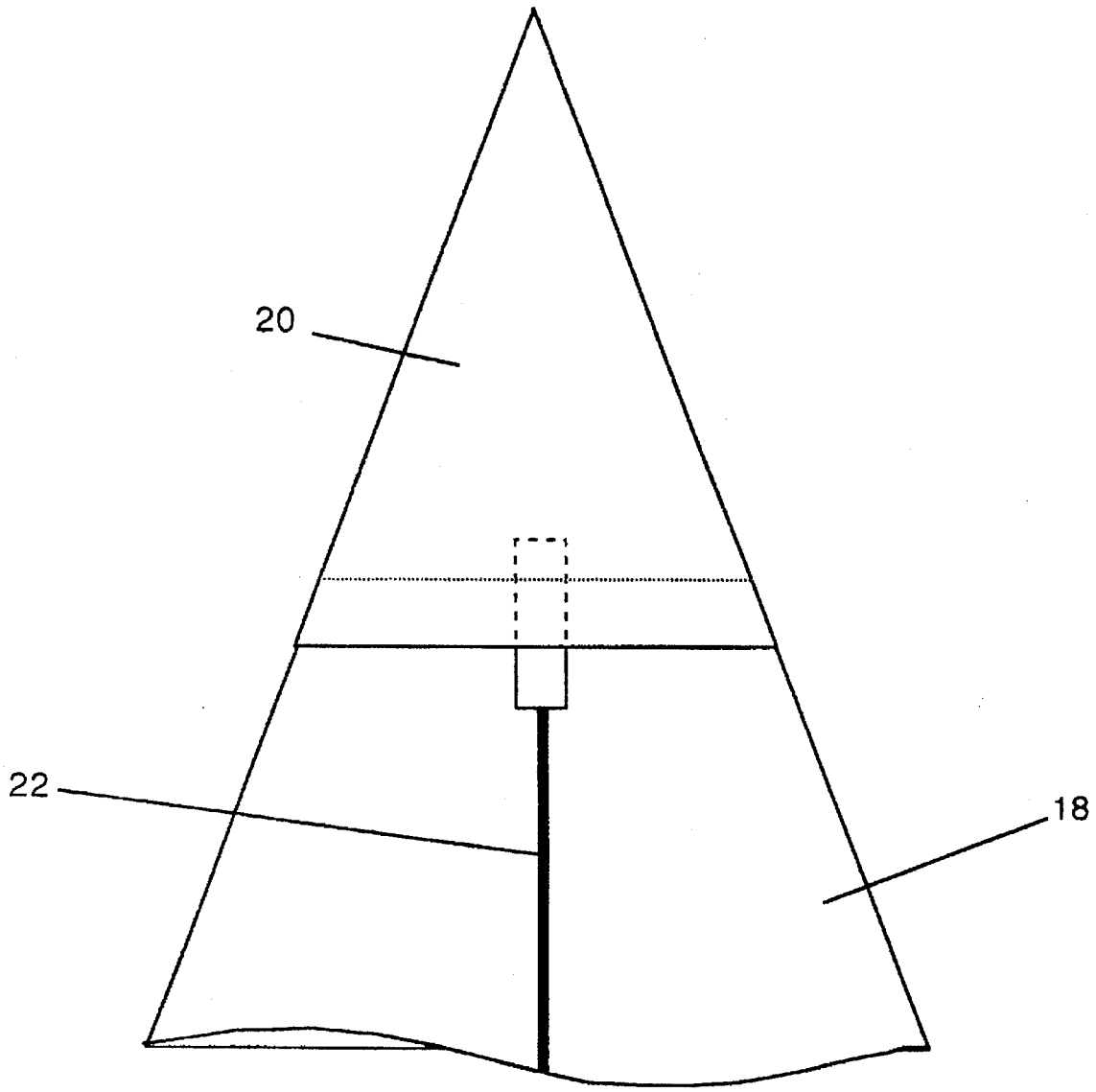
FIG. 4 is a detail view of the zipper and weathergaurd portion, a part of device 10.

In FIG. 4 we see a detailed view of how weathergaurd panel 20 overlaps the top of front panel 18. This is to provide a weather seal for the top of sport zipper 22.

OPERATION OF INVENTION

The Dry or Cool accessories bag is easily attached to conventional pull-type golf carts as shown in FIG. 1. First one would set up the golf cart in the ready to use position, the conventional golf bag may, or may not be on the cart when attaching the Dry or Cool accessories bag. Once the golf cart is set up one would place the Dry or Cool accessories bag between the wheels of the golf cart. One would then place the top attachment strap 26 located near the apex of device 10 around the frame of the golf cart. This strap should be located at the pivot point of the frame ensuring that it is placed in such a way that the strap will not slide up or down on the golf cart frame. One would then secure the strap by passing the free end through the "D" rings 24 and pulling until snug. This process is repeated for the lower strap located on the bottom of the long seam of device 10. One then would place attachment straps 26 located on the lower front corners of device 10 around a point nearest the wheels of the golf cart, and secure with "D" rings 24. One should take care to ensure that these straps do not interfere with the free rotation of the wheels. The Dry or Cool accessories bag is now ready for use. To gain entry to the interior one would grasp the tab of the sport zipper 22 and pull downward producing a vertical opening in front panel 18. One would then place their chosen contents into the interior of the Dry or Cool accessories bag. Once again grasp the tab of sport zipper 22 and pull upward effectively closing the bag.

For storage one would leave the Dry or Cool accessories bag in place and fold the pull cart in the normal manner. The Dry or Cool accessories bag will collapse with the cart folding away in the space between the wheels and the handle.

CONCLUSION, RAMIFICATIONS, AND SCOPE OF INVENTION

Accordingly the reader will see that the Dry or Cool accessories bag is inexpensive and simple to produce. It is easily attached to a pull-type golf cart utilizing an existing unused space. Additional advantages of the Dry or Cool accessories bag are

- it can hold a variety of items from canned or bottled beverages, to extra socks or rain gear;
- it can be left in place and will fold up with the golf cart for transportation and storage;
- it can be fabricated in a variety of colors from existing materials produced by the textile industry; and
- it is durable, lightweight and water resistant.

Although the previously disclosed description contains many specificity's, these should not be construed as limiting the scope of the invention but as merely providing an illustration of the presently preferred embodiment of the invention. For example, the Dry or Cool accessories bag may be made from insulated material, it may use buckles or hooks rather than "D" rings, it can be made in a variety of shapes, it may attach to any portion of the golf cart frame, it may be attached to golf bags with an auto stand, it may have draw strings, it may utilize other methods than a zipper for accessing the interior, etc.

Thus the scope of the invention should be determined by the appended claims and their legal equivalents, rather than by the examples given.

We claim:

1. A three sided pyramidically shaped accessories bag adapted for attachment to framework of a pull-type golf cart comprising:

four elongated adjustable straps attached at four locations to said accessories bag, closure means for permitting access to an interior of said accessories bag, securement means associated with said elongated adjustable straps for securing said accessories bag to the framework of a pull-type golf cart, wherein one of said elongated adjustable straps is attached at an uppermost apex of said accessories bag and is secured to a mid point of said pull-type golf cart, a second of said elongated adjustable straps is attached to a lower rear apex of said accessories bag and secured to a lower most section of said pull-type golf cart framework, the remaining two of said elongated adjustable straps attached, one each, to a point near opposing lower front apexes along a line between said lower front apexes and said lower rear apex, said two elongated adjustable straps secured to members of said pull-type golf cart framework near opposing wheels of said pull-type golf cart, whereby said accessories bag is supported by applying tension to said elongated adjustable straps to suspend said accessories bag in a substantially pyramidical shape between the aforementioned four securement locations of said accessories bag with said pull-type golf cart framework.

2. The accessories bag of claim 1 wherein said accessories bag comprises:

supple material having edges joined to form said pyramidical shape of a base and three sides, said base and said three sides having four common apexes, two of said three sides being equal in shape and size, formed from a substantially square section of said supple material folded along a line between opposing corners to form two right triangles with their right angles opposing each other and dispersed form each other, the other one of said three sides constructed of said supple material to from a front triangle incorporating said closure means, said front triangle attached to two edges of substantially vertical legs of said right triangles to form said uppermost apex, a second, substantially smaller, triangle attached to said front triangle so as to share said uppermost apex as a common apex, said second triangle being unattached at the base so as to partially cover said closure means to provide a weather-guard, and a bottom triangle formed from said supple material with a base equal in length to the base of said front triangle, the base of said bottom triangle attached to the base of the front triangle with the remaining edges of said bottom triangle attached to base legs of said right triangles, whereby an enclosure is formed that is substantially pyramidical in shape with four common apexes.

3. The accessories bag of claim 1 wherein said securement means comprises paired "D" rings provided on said elongated adjustable straps.

4. The accessories bag of claim 2 wherein said closure means comprises a zipper, having a top, constructed in said front panel.

5. The accessories bag of claim 4 wherein said zipper is arranged to extend vertically in the center of said front panel with the top of said zipper located below said uppermost apex and under said weather-guard, said zipper extending to a point short of the base of said front triangle.

6. A pyramidically shaped accessories bag adopted for attachment to framework of a pull-type golf cart comprising:

a) a plurality of elongated adjustable straps attached to said accessories bag;

b) closure means for permitting access to an interior of said accessories bag;

c) securement means associated with said plurality of elongated straps for securing said accessories bag to the framework of a pull-type golf cart;

d) wherein said accessories bag has a support structure formed of a top and a multi-sided base, wherein said multi-sided base has at least three sides, and further such that the sides of said multi-sided base are jointed at points that form apexes; and e) wherein said plurality of elongated adjustable straps are attached to said accessories bag at a plurality of points on said base and top of said accessories bag, such that said accessories bag is supported by applying tension to said plurality of elongated adjustable straps to suspend said accesories bag in a substantially pyramidal shape on said framework of said pull-type golf cart.

7. The accessories bag of claim 6 wherein the securement means comprises paired "D" rings provided on said elongated straps.

8. The accessories bag of claim 6 wherein said closure means comprises a zipper, having a top, constructed in said front panel.

* * * * *